United States Patent [19]

Ikeda et al.

[11] 4,436,973

[45] Mar. 13, 1984

[54] HIGH FREQUENCY HEATING APPLIANCE WITH AN ANTENNA AND STIRRER ASSEMBLY

[75] Inventors: Nobuo Ikeda; Hirofumi Yoshimura, both of Nara, Japan

[73] Assignee: Matsushita Electric Industrial Co., Ltd., Osaka, Japan

[21] Appl. No.: 367,601

[22] Filed: Apr. 12, 1982

[30] Foreign Application Priority Data

May 15, 1981 [JP] Japan ..... 56-73701

[51] Int. Cl.[3] ..... H05B 6/74

[52] U.S. Cl. ..... 219/10.55 F; 219/10.55 R

[58] Field of Search ..... 219/10.55 F, 10.55 R, 219/10.55 A, 10.55 D

[56] References Cited

U.S. PATENT DOCUMENTS

| | | | |
|---|---|---|---|
| 4,019,010 | 4/1977 | Tanaka et al. | 219/10.55 F |
| 4,132,239 | 1/1979 | Bowen et al. | 219/10.55 D X |
| 4,284,868 | 8/1981 | Simpson | 219/10.55 F |

FOREIGN PATENT DOCUMENTS

| | | | |
|---|---|---|---|
| 47-39248 | 10/1972 | Japan | 219/10.55 F |
| 53-148748 | 12/1978 | Japan | 219/10.55 F |
| 54-10448 | 1/1979 | Japan | 219/10.55 R |
| 54-161141 | 12/1979 | Japan | 219/10.55 A |

*Primary Examiner*—B. A. Reynolds
*Assistant Examiner*—Philip H. Leung
*Attorney, Agent, or Firm*—Wenderoth, Lind & Ponack

[57] ABSTRACT

A high frequency heating appliance which includes a magnetron, which is used as a high frequency oscillator, and which is directly mounted in a heating chamber and which further includes a stirrer fan for ensuring a uniform electric field distribution of high frequency electromagnetic radiation in the chamber; the fan is mounted coaxially with an antenna for the magnetron; the stirrer fan is provided with a vertical metallic segment for high frequency impedance matching and the vertical metallic segment has a horizontal metallic subsegment located on its end which is oriented so as to be substantially at right angles with the vertical metallic segment for providing a sufficient capacitive coupling between the wall of the heating chamber and the horizontal metallic subsegment with an adequate gap being secured from the heating chamber wall supporting the magnetron. The above-noted construction ensures an improved efficiency and improved distribution of the high frequency output of the magnetron.

7 Claims, 7 Drawing Figures

HIGH FREQUENCY HEATING APPLIANCE WITH AN ANTENNA AND STIRRER ASSEMBLY

BACKGROUND OF THE INVENTION

In the past years, many patents were issued for stirrer fans. With a high frequency heating appliance of the type which has a high frequency oscillator mounted directly on a wall of the heating chamber, it is well known that the high frequency oscillator is disposed at the center of the heating chamber and a stirrer fan is rotated concentrically with a dipole antenna extending from the oscillator in order to ensure good distribution of the heating energy.

A severe limitation is placed on the dimensions of the heating chamber. In other words, in the event that the impedance of the high frequency oscillator, typically a magnetron, doesn't match the impedance of the load, the appliance fails to properly deliver a high frequency output. A conventional approach to attain impedance matching is to adjust the dimensions of the heating chamber. For example, in order to enable the appliance to provide a high frequency output with any size heating chamber, a waveguide is disposed between the heating chamber and the high frequency oscillator for providing an impedance adjustment. This method however entails high frequency loss in the waveguide and thus causes a decrease in the high frequency output.

Another conventional approach is to provide a metal plate fixedly secured in the vicinity of the dipole antenna. However, this method has a problem in that the position of the metal plate varies from appliance to appliance and spark discharges take place thereabout. As another alternative, a metal blade, which is arranged so as to be parallel to the dipole antenna, is mounted on the stirrer fan in the vicinity of the dipole antenna so as to attain impedance matching. Since this approach is inefficient unless the tip of the metal blade is placed close to the wall of the heating chamber bearing the dipole antenna mounted thereon, the approach still has outstanding problems with respect to output power losses, the concentration of the electric field, and an increase in the resistance losses which occur in the metal blade.

SUMMARY OF THE INVENTION

The present invention has the following objects:

(1) Providing a stirrer fan assembly for use in a high frequency heating appliance having a high frequency oscillator with a dipole antenna installed directly in a heating chamber; the assembly provides an improved high frequency output and a better distribution of the high frequency energy throughout the heating chamber irrespective of the size of the heating chamber.

(2) Providing a stirrer fan having no possibility of spark discharges occurring between the stirrer and hardware, such as screws used for the installation of the high frequency oscillator, when no load is in the heating chamber.

(3) Providing a stirrer fan by which variations in the characteristics of the high frequency radiation due to finite size tolerances are alleviated.

(4) Providing a stirrer fan which is lightweight and highly resistant to mechanical damage and vibration.

(5) Providing a stirrer fan which stably operates even when the appliance is being inclined.

DESCRIPTION OF THE PREFERRED EMBODIMENT

It is an object of the present invention to provide a stirrer fan which is free of the above-noted problems of the prior art and which can easily attain impedance matching by providing a vertical metallic segment thereon which is parallel to a dipole antenna and by providing a horizontal metallic subsegment which is located on the vertical metallic segment and which has the dipole antenna mounted thereon.

As an illustrative example, a household microwave oven constructed in accordance with the present invention will be described in detail.

Figure 1:
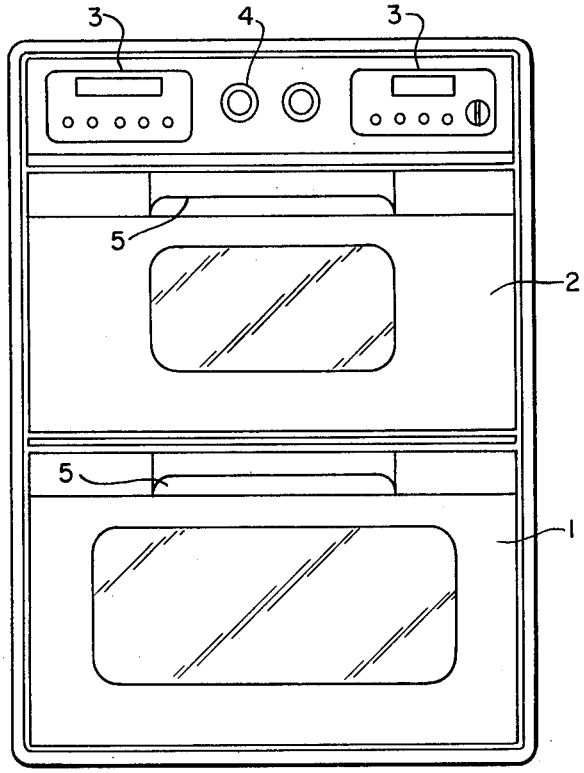
FIG. 1 is a front view of a two-oven type high frequency heating appliance according to an embodiment of the present invention.

FIG. 1 illustrates a front view of a combination microwave oven and range of the two-oven built-in type which includes an electric heater oven in its lower portion and a microwave oven in its upper portion. This appliance includes a door 1 for the electric oven and a door 2 for the microwave oven and an operational panel over the microwave oven. The panel has electronic controls 3 for the operation of the respective ovens and temperature-adjusting knobs 4. Each of the respective doors is provided with a handle 5.

Figure 2:
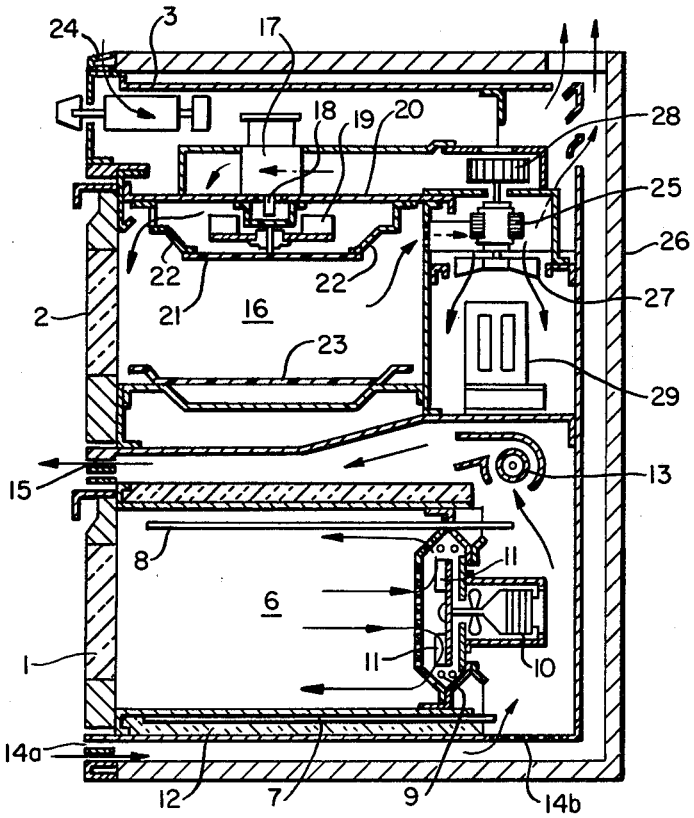
FIG. 2 is an elevational cross-sectional view of the appliance of FIG. 1.

FIG. 2 is an elevational cross-sectional view of the appliance of FIG. 1. A heating chamber 6 for the lower oven includes a bottom heater 7, a top heater 8 and a circulating fan heater 9 for elevating its air temperature. To obtain a uniform distribution of temperature, a circulation fan 11 is rotated by a motor 10. On the periphery of the heating chamber 6 of the lower oven there is provided a heat insulating member 12. An oven fan 13 is further provided for ventilation of the lower oven. Air is circulated within the heating chamber 6 of the lower oven as depicted by the arrows with the help of the circulation fan 10. Ventilation air flows within the lower oven especially from bottom air inlets **14*a* to central air outlets 15 via perforations 14*b*** formed in the bottom of the appliance body.

The microwave oven will now be described in more detail. A high frequency oscillator 17, typically a magnetron, is secured directly at the center of a top wall of the heating chamber 16 and a dipole 18 of the magnetron 17 radiates high frequency waves toward the heating chamber 16. A stirrer fan 19 is rotated concentrically with the dipole antenna 18.

Disposed within the heating chamber 16 is a top plate 21 of low loss dielectric material for keeping food (not shown) away from the stirrer fan 19 together with fixtures therefor. A platform 23 is also disposed within the chamber 16 for receiving the food thereon.

Air enters the microwave oven portion via an air inlet 24 formed in an upper portion of the body thereof and cools the electronic controller 3; the air for cooling the magnetron is moved past the magnetron 17 with the aid of a centrifugal fan 28 driven by a cooling motor 25 and causes the stirrer fan 19 to rotate due to its wind force and finally leaves the cabinet 26 via an upper back air outlet after running through the heating chamber. A propeller fan 27, on the other hand, is rotated with the cooling motor 25, permitting cooling air to cool such electric components as a transformer 29 and so forth and finally leaves the cabinet 26 via the upper back outlet. The heating chamber 6 of the lower oven is thermally shielded so that no transmission of heat takes place through the microwave oven, the electronic controller 3, etc. Accordingly, the electric components are never damaged by heat when the lower oven and the upper microwave oven are operated simultaneously.

Figure 3:
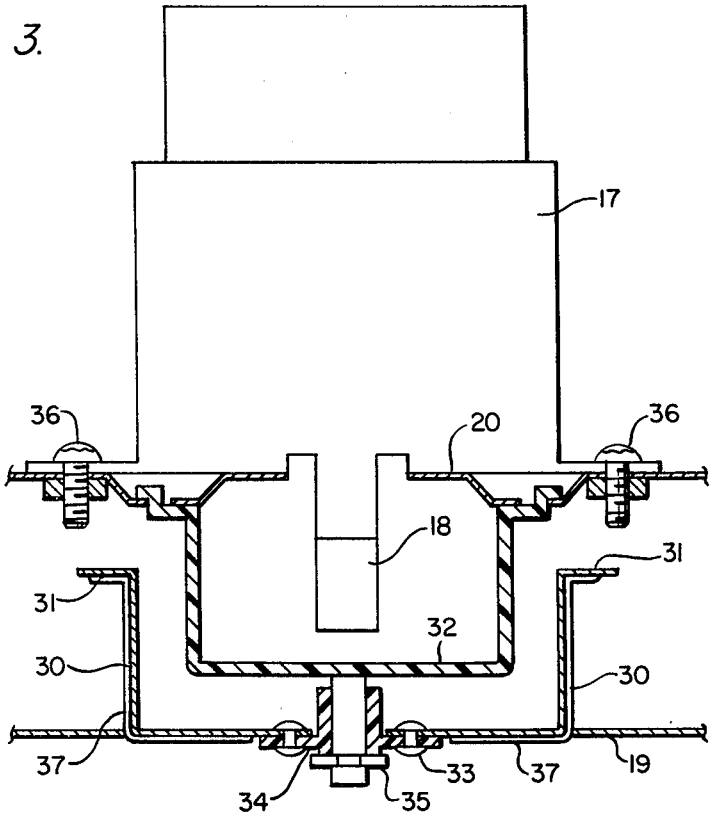
FIG. 3 is an enlarged cross-sectional view of an energy supply section.

FIG. 3 is an enlarged view of a principal part of the appliance of FIG. 2. High frequency waves from the magnetron 17 are directed from the dipole antenna 18 to the interior of the heating chamber 16. To attain impedance matching with the load (food or the like) under this condition, a plurality of vertical metallic segments 30 is provided on the stirrer fan 19 in the neighborhood of the dipole antenna. Furthermore, horizontal metallic subsegments 31 are formed on right-angled tips of these vertical metallic segments. The stirrer fan 19 may be rotated concentrically with the dipole antenna 18 through provision of a stirrer shaft 32 made of low loss dielectric material together with a spacer 34 mounted thereon via rivets 33 or the like. The spacer 34 is prevented from falling down by a ring 35. Screws 36 or the like are provided for installation of the magnetron on the top wall 20 of the heating chamber and are exposed to the heating chamber 16 so that an electric field between the vertical metallic segments 30 and the screws 36 becomes stronger so as to cause a spark discharge and a substantial amount of high frequency current through the screws 36 and the vertical metallic segments 30 so as to thereby decrease the high frequency output level as the vertical metallic segments 30 approach the screws 36 or the like. The vertical metallic segments 30, the horizontal metallic subsegments 31 and the stirrer fan 19 are respectively provided with ribs 37 which in turn prevent the relative angular position therebetween from varying so as to thereby prevent the deterioration of the high frequency output or energy distribution due to small vibrations or movement therebetween.

Figure 4:
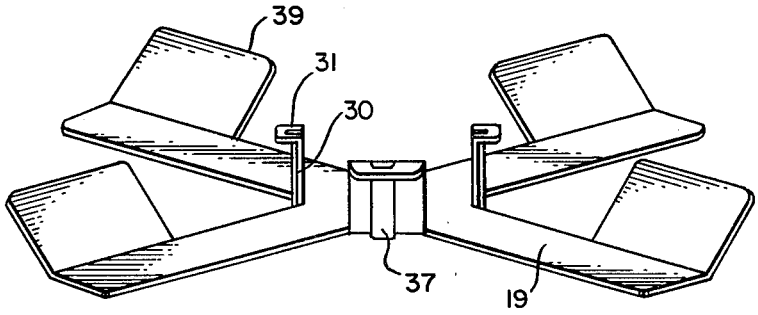
FIG. 4 is an enlarged perspective view of a stirrer fan in accordance with the present invention.

FIG. 4 is a perspective view of the stirrer fan 19. The stirrer fan 19 has four stirrer blades 39 whose function is to receive the force of the cooling air for causing rotation so as to stir the high frequency electromagnetic field to cause a uniform distribution thereof. Each of the respective corners of the horizontal metallic subsegments 31 is rounded so as not to concentrate the electric field.

Figure 6:
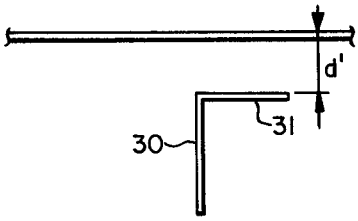
FIGS. 5 and 6 are views for explaining the operation of the present invention.
Figure 5:
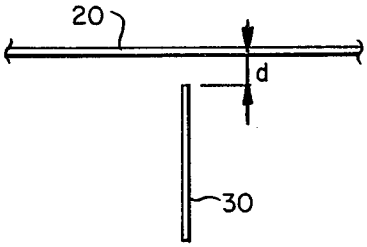
Figure 7:
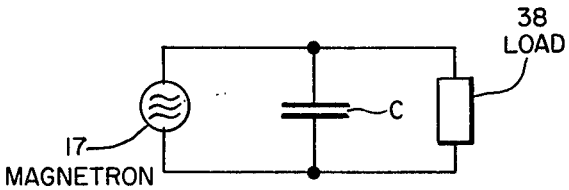
FIG. 7 is an equivalent circuit diagram.

FIGS. 5, 6 and 7 are equivalent diagrams for explaining the electrical function of the horizontal metallic subsegments 31 and the vertical metallic segments 30.

When the vertical metallic segments 30 are provided in the vicinity of the dipole antenna as shown in FIG. 5, there is generally created a gap d with regard to a dipole antenna-bearing plane, namely, the top wall 20 of the heating chamber. This can be represented in an equivalent circuit diagram of FIG. 7 wherein a capacitor c is placed in parallel with the magnetron 17 and the load (food) 38 so that impedance matching may be assured between the magnetron 17 and the load 38 and so that the high frequency output is absorbed into the load to a maximum permissible extent. Since the capacitance of the capacitor c is dependent upon the gap d of FIG. 5, it will not increase unless the gap d is decreased. However, if the gap d is too small, a spark discharge occurs and the high frequency loss becomes greater. As is clear from FIG. 6, the gap d' that yields the same capacitance c is greater than the gap d of FIG. 5 according to the present invention which features the provision of the horizontal metallic subsegments 31 on the tips of the vertical metallic segments 30.

There is therefore no possibility of causing a spark discharge or increasing losses, even though the screws 36 extend into the heating chamber 16 as suggested in FIG. 3. It is obvious to those skilled in the art that the performance of the capacitance c is not effective unless the gaps d and d' are equal to or less than $\frac{1}{8}$ of the wavelength of the high frequency waves. The results of experiments confirm the fact that the effect of the vertical metallic segments 30 is greater when the segments are oriented in a direction which is perpendicular to the dipole antenna 18 and the high frequency waves from the dipole antenna 18 are agitated more effectively when the plurality of the vertical metallic segments 30, especially three segments, are oriented at a right angle.

As noted earlier, the present invention offers advantageous features as follows:

(1) In the appliance of the type which includes the high frequency oscillator mounted directly in the heating chamber, it is easy to attain impedance matching with a resultant increased amount of high frequency output.

(2) Since a greater gap is allowed to stand between the wall of the heating chamber and the vertical metallic segments, there is no possibility of causing a spark discharge or increasing high frequency losses, even when the stirrer is inclined or the mounting screws are exposed in the heating chamber.

(3) Since variations in the capacitance are small even when the dimensions of the stirrer fan, especially those of the horizontal metallic subsegments and those of the vertical metallic segments, are varied or the stirrer is somewhat inclined and variations in the high frequency output level are correspondingly small when the ovens are mass produced.

(4) Through the provision of the ribs at the horizontal metallic subsegments and the vertical metallic segments, the stirrer fan is itself undeformable and doesn't cause deterioration of the output distribution and oven performance even under vibration of the body.

(5) The provision of the plurality of the vertical metallic segments not only assures impedance matching but improves the energy distribution.

(6) The stirrer may be rotated concentrically with the dipole antenna of the magnetron with a simple structure thanks to the force of the cooling air.

(7) Uniform heating is ensured through the magnetron installed at the center of the top and bottom walls of the heating chamber when a plurality of foodstuffs are loaded in the heating chamber.

What is claimed is:

1. A high frequency heating appliance comprising:

a heating chamber having a plurality of walls and disposed in a main body of said appliance;

a high frequency oscillator, having a dipole antenna and having a stirrer fan which is made from a metallic plate and which is used for stirring high frequency waves radiated from said high frequency oscillator toward the interior of said heating chamber, said stirrer fan having a rotary shaft concentric with said dipole antenna;

wherein said stirrer fan includes a plurality of stirrer blades and further includes at least one vertical metallic segment which is arranged so as to be substantially parallel to said dipole antenna and located adjacent thereto, said at least one vertical segment of said stirrer fan further including a horizontal metallic subsegment which is arranged so as to be substantially parallel to a wall of said heating chamber having said dipole antenna installed thereon, and wherein the distance between said horizontal metallic subsegment and said wall of the heating chamber is selected to be shorter than $\frac{1}{8}$ of the wavelength of said high frequency waves;

and wherein said at least one vertical metallic segment is disposed in a direction which is substantially normal to the direction of the high frequency waves radiated from said dipole antenna.

2. A high frequency heating appliance as defined in claim 1, wherein said stirrer fan is rotated by applying cooling air to said stirrer blades, said cooling air also being used for cooling said high frequency oscillator.

3. A high frequency heating appliance as defined in claim 1, wherein said horizontal metallic subsegment has rounded corners at its respective corners.

4. A high frequency heating appliance as defined in claim 1, wherein said at least one vertical metallic segment and said horizontal metallic subsegment are respectively provided with ribs.

5. A high frequency heating appliance as defined in claim 1, wherein said heating chamber is generally of a rectangular shape and wherein said dipole antenna is installed on one of either the top or bottom of said rectangular shape.

6. A high frequency heating appliance as defined in claim 1, wherein said at least one vertical metallic segment comprises a plurality of vertical metallic segments.

7. A high frequency heating appliance as defined in claim 6, wherein said plurality of vertical metallic segments are arranged so as to be one of either normal to or parallel with each other.

* * * * *